US010332481B2

(12) United States Patent
Atkins et al.

(10) Patent No.: US 10,332,481 B2
(45) Date of Patent: Jun. 25, 2019

(54) ADAPTIVE DISPLAY MANAGEMENT USING 3D LOOK-UP TABLE INTERPOLATION

(71) Applicant: Dolby Laboratories Licensing Corporation, San Francisco, CA (US)

(72) Inventors: Robin Atkins, San Jose, CA (US); Samir N. Hulyalkar, Los Gatos, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 52 days.

(21) Appl. No.: 15/341,932

(22) Filed: Nov. 2, 2016

(65) Prior Publication Data

US 2017/0124983 A1 May 4, 2017

Related U.S. Application Data

(60) Provisional application No. 62/249,622, filed on Nov. 2, 2015.

(51) Int. Cl.

| | |
|---|---|
| ***G09G 5/06*** | (2006.01) |
| ***G09G 5/10*** | (2006.01) |
| ***G09G 5/04*** | (2006.01) |

(52) U.S. Cl.

CPC ..... *G09G 5/06* (2013.01); *G09G 5/04* (2013.01); *G09G 5/10* (2013.01);

(Continued)

(58) Field of Classification Search

None

See application file for complete search history.

(56) References Cited

U.S. PATENT DOCUMENTS

| | | | |
|---|---|---|---|
| 6,539,110 | B2 | 3/2003 | Myers |
| 6,587,117 | B1 | 7/2003 | Wright |

(Continued)

FOREIGN PATENT DOCUMENTS

| | | |
|---|---|---|
| KR | 2013-096970 | 9/2013 |
| WO | 2014/130343 | 8/2014 |

(Continued)

OTHER PUBLICATIONS

ITU-R Radiocommunication Sector of ITU, Recommendation ITU-R BT.1886 "Reference Electro-Optical Transfer junction for Flat Panel Displays Used in HDTV Studio Production" Mar. 2011, pp. 1-7.

(Continued)

*Primary Examiner* — Yi Wang

(57) ABSTRACT

Methods are disclosed for adaptive display management using look-up table interpolation. Given a target maximum brightness value for a display, a new look-up table (LUT) for color gamut mapping is determined based on interpolating values from two other pre-computed color gamut LUTs; one computed for a first maximum display brightness larger than the target maximum brightness value, and one computed for a second maximum display brightness lower than the target brightness value. An interpolation scale is computed based at least on the target maximum brightness value and the first maximum display brightness. Methods to reduce the computation load for the translation of RGB data from one color representation (say, ST 2084) to another color representation (say, BT 1866) using fast interpolation methods are also presented.

15 Claims, 4 Drawing Sheets

(52) U.S. Cl.
CPC ..... *G09G 2320/0626* (2013.01); *G09G 2320/0666* (2013.01); *G09G 2320/0673* (2013.01); *G09G 2340/06* (2013.01); *G09G 2360/16* (2013.01)

(56) References Cited

U.S. PATENT DOCUMENTS

| | | | | |
|---|---|---|---|---|
| 8,154,563 | B2 | 4/2012 | Park | |
| 8,963,947 | B2 | 2/2015 | Wan | |
| 2012/0169719 | A1 | 7/2012 | Kim | |
| 2012/0188229 | A1 | 7/2012 | Wan | |
| 2013/0120656 | A1* | 5/2013 | Wilson | G06F 3/1462 348/563 |
| 2017/0085895 | A1* | 3/2017 | Gu | H04N 19/44 |

FOREIGN PATENT DOCUMENTS

| | | |
|---|---|---|
| WO | 2015/073377 | 5/2015 |
| WO | 2016/183234 | 11/2016 |

OTHER PUBLICATIONS

SMPTE ST 2084:2014 "High Dynamic Range EOTF of Mastering Reference Displays" Aug. 16, 2014, The Society of Motion Picture and Television Engineers.

Ebner, F. et al "Development and Testing of a Color Space (IPT) with Improved Hue Uniformity" Proc. 6th Color and Imaging Conference Final Program and Proceedings, Society for Imaging Science and Technology, pp. 8-13(6), Jan. 1, 1998.

* cited by examiner

ADAPTIVE DISPLAY MANAGEMENT USING 3D LOOK-UP TABLE INTERPOLATION

CROSS-REFERENCE TO RELATED APPLICATIONS

This application claims the benefit of priority to U.S. Provisional Patent Application Ser. No. 62/249,622, filed on Nov. 2, 2015, which is hereby incorporated herein by reference in its entirety.

TECHNOLOGY

The present invention relates generally to images. More particularly, an embodiment of the present invention relates to adaptive display management using 3D look-up table interpolation.

BACKGROUND

As used herein, the terms "display management" or "display mapping" denote the processing (e.g., tone and gamut mapping) required to map an input video signal of a first dynamic range (e.g., 1000 nits) to a display of a second dynamic range (e.g., 500 nits). Examples of display management processes can be found in WIPO Publication Ser. No. WO2014/130343 (to be referred to as the '343 publication), "Display Management for High Dynamic Range Video," which is incorporated herein by reference in its entirety.

As used herein, the term 'dynamic range' (DR) may relate to a capability of the human visual system (HVS) to perceive a range of intensity (e.g., luminance, luma) in an image, e.g., from darkest blacks (darks) to brightest whites (highlights). In this sense, DR relates to a 'scene-referred' intensity. DR may also relate to the ability of a display device to adequately or approximately render an intensity range of a particular breadth. In this sense, DR relates to a 'display-referred' intensity. Unless a particular sense is explicitly specified to have particular significance at any point in the description herein, it should be inferred that the term may be used in either sense, e.g. interchangeably.

A reference electro-optical transfer function (EOTF) for a given display characterizes the relationship between color values (e.g., luminance) of an input video signal to output screen color values (e.g., screen luminance) produced by the display. For example, ITU Rec. ITU-R BT. 1886, "Reference electro-optical transfer function for flat panel displays used in HDTV studio production," (03/2011), which is incorporated herein by reference in its entity, defines the reference EOTF for flat panel displays based on measured characteristics of the Cathode Ray Tube (CRT). Given a video stream, any ancillary information is typically embedded in the bit stream as metadata. As used herein, the term "metadata" relates to any auxiliary information that is transmitted as part of the coded bitstream and assists a decoder to render a decoded image. Such metadata may include, but are not limited to, color space or gamut information, reference display parameters, and auxiliary signal parameters, as those described herein.

Most consumer HDTVs range from 300 to 500 nits with new models reaching 1000 nits (cd/m$^2$). As the availability of HDR content grows due to advances in both capture equipment (e.g., cameras) and displays (e.g., the PRM-4200 professional reference monitor from Dolby Laboratories), HDR content may be color graded and displayed on displays that support higher dynamic ranges (e.g., from 1,000 nits to 5,000 nits or more). Such displays may be defined using alternative EOTFs that support high luminance capability (e.g., 0 to 10,000 nits). An example of such an EOTF is defined in SMPTE ST 2084:2014 "High Dynamic Range EOTF of Mastering Reference Displays," which is incorporated herein by reference in its entirety. In general, without limitation, the methods of the present disclosure relate to any dynamic range higher than SDR. As appreciated by the inventors here, improved techniques for the display of high-dynamic range images are desired.

The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF THE DRAWINGS

An embodiment of the present invention is illustrated by way of example, and not in way by limitation, in the figures of the accompanying drawings and in which like reference numerals refer to similar elements and in which.

DESCRIPTION OF EXAMPLE EMBODIMENTS

Techniques for backlight control and display management or mapping of high dynamic range (HDR) images are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

Overview

Example embodiments described herein relate to adaptive display management of HDR images using 3D look-up table (LUT) interpolation. In an embodiment, two or more look-up tables (LUTs) related to display management (say, for color gamut mapping) are precomputed for a set of distinct maximum brightness values for a display. Given a target maximum brightness value which does not match any of the values in the set, a new output look-up table is determined based on interpolating values from two of the pre-computed LUTs; one LUT pre-computed for a first maximum display brightness larger than the target maximum brightness value, and one LUT pre-computed for a second maximum display brightness lower than the target brightness value. An interpolation scale is computed based at least on the target maximum brightness value and the first maximum display brightness.

In an embodiment, the process of converting the output of a 3D color-gamut mapping LUT from a first color representation (say, RGB in ST 2084) to a second color representation (say, RGB in BT 1886) may be simplified by a) pre-computing a set of ST 2084 (PQ) to BT 1886 (gamma) tables for a small set of possible maximum brightness values for the target display and b) by interpolating values from these tables to perform color conversion given the target brightness value of the target display.

In one embodiment, the interpolation scale is computed based on a linear interpolation of the target brightness between the first maximum display brightness and the second maximum display brightness in the first color representation (say, RGB ST 2084).

In another embodiment, the interpolation scale is computed based on a linear interpolation of the target brightness between the first maximum display brightness and the second maximum display brightness in the second color representation (say, BT 1866).

Example Display Control and Display Management

Figure 1:
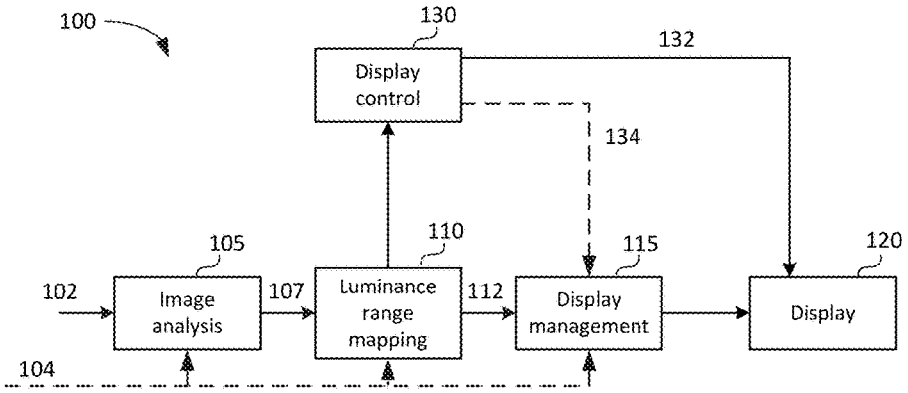
FIG. 1 depicts an example process for backlight control and display management according to an embodiment of this invention.

FIG. 1 depicts an example process (100) for display control and display management according to an embodiment. Input signal (102) is to be displayed on display (120). Input signal may represent a single image frame, a collection of images, or a video signal. Image signal (102) represents a desired image on some source display typically defined by a signal EOTF, such as ITU-R BT. 1886 or SMPTE ST 2084, which describes the relationship between color values (e.g., luminance) of the input video signal to output screen color values (e.g., screen luminance) produced by the target display (120). The display may be a movie projector, a television set, a monitor, and the like, or may be part of another device, such as a tablet or a smart phone.

Process (100) may be part of the functionality of a receiver or media player connected to a display (e.g., a cinema projector, a television set, a set-top box, a tablet, a smart-phone, a gaming console, and the like), where content is consumed, or it may be part of a content-creation system, where, for example, input (102) is mapped from one color grade and dynamic range to a target dynamic range suitable for a target family of displays (e.g., televisions with standard or high dynamic range, movie theater projectors, and the like).

In some embodiments, input signal (102) may also include metadata (104). These can be signal metadata, characterizing properties of the signal itself, or source metadata, characterizing properties of the environment used to color grade and process the input signal (e.g., source display properties, ambient light, coding metadata, and the like).

In some embodiments (e.g., during content creation), process (100) may also generate metadata which are embedded into the generated tone-mapped output signal. A target display (120) may have a different EOTF than the source display. A receiver needs to account for the EOTF differences between the source and target displays to accurate display the input image. Display management (115) is the process that maps the input image into the target display (120) by taking into account the two EOTFs as well as the fact that the source and target displays may have different capabilities (e.g., in terms of dynamic range.)

In some embodiments, the dynamic range of the input (102) may be lower than the dynamic range of the display (120). For example, an input with maximum brightness of 100 nits in a Rec. 709 format may need to be color graded and displayed on a display with maximum brightness of 1,000 nits. In other embodiments, the dynamic range of input (102) may be the same or higher than the dynamic range of the display. For example, input (102) may be color graded at a maximum brightness of 5,000 nits while the target display (120) may have a maximum brightness of 1,500 nits.

In an embodiment, unless specified already by the source metadata (104), for each input frame in signal (102) the image analysis (105) block may compute its minimum (min), maximum (max), and median (mid) (or average gray) luminance value. These values may be computed for the whole frame or part of a frame. Given min, mid, and max luminance source data (107 or 104), image processing block (110) may compute the display parameters (e.g., the level of backlight) that allow for the best possible environment for displaying the input video on the target display.

In an embodiment, display (120) is controlled by display controller (130). Display controller (130) provides display-related data (134) to the display mapping process (115) (such as: minimum and maximum brightness of the display, color gamut information, and the like) and control data (132) for the display, such as control signals to modulate the backlight or other parameters of the display for either global or local dimming.

Displays using global or local backlight modulation techniques adjust the backlight based on information from input frames of the image content and/or information received by local ambient light sensors. For example, for relatively dark images, the display controller (130) may dim the backlight of the display to enhance the blacks. Similarly, for relatively bright images, the display controller may increase the backlight of the display to enhance the highlights of the image.

Figure 2:
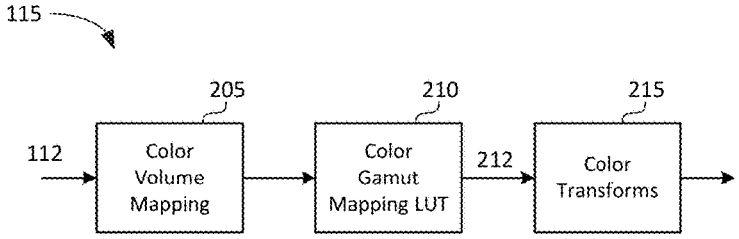
FIG. 2 depicts an example process for display management using a 3D look-up table for color gamut mapping according to an embodiment of this invention.

As described in WO2014/130343, and depicted in FIG. 2, given an input (112), the display characteristics of a target display (120), and metadata (104), the display management process (115) may be sub-divided into two main steps:

a) Step (205)—Determining the optimum color volume mapping (CVM) for the target display b) Step (210)—Determining the optimum color gamut mapping (CGM) for the target display As used herein, the term "color volume space" denotes the 3D volume of colors that can be represented in a video signal and/or can be represented in display. Thus, a color volume space characterizes both luminance and color/chroma characteristics. For example, a first color volume "A" may be characterized by: 400 nits of peak brightness, 0.4 nits of minimum brightness, and Rec. 709 color primaries. Similarly, a second color volume "B" may be characterized by: 4,000 nits of peak brightness, 0.1 nits of minimum brightness, and Rec. 709 primaries.

During color volume mapping (205), display management operates on the input signal to adjust its intensity (luminance) and chroma to match the characteristics of a target display. This step may result in colors outside of the target display gamut. During color gamut mapping (210), a 3D color gamut look-up table (LUT) may be computed and applied to adjust the color gamut. In some embodiment, an optional color transformation step (215) may also be used to translate the output of CGM (212) (say, RGB) to a color representation suitable for display or additional processing (say, YCbCr).

In some embodiment, color volume mapping may be performed in the IPT-PQ color space. The term "PQ" as used herein refers to perceptual quantization. The human visual system responds to increasing light levels in a very non-linear way. A human's ability to see a stimulus is affected by the luminance of that stimulus, the size of the stimulus, the spatial frequency or frequencies making up the stimulus, and the luminance level that the eyes have adapted to at the particular moment one is viewing the stimulus. In a preferred embodiment, a perceptual quantizer function maps linear input gray levels to output gray levels that better match the contrast sensitivity thresholds in the human visual system. An example of a PQ mapping function is described in the SMPTE ST 2084 specification, where given a fixed stimulus size, for every luminance level (i.e., the stimulus level), a minimum visible contrast step at that luminance level is selected according to the most sensitive adaptation level and the most sensitive spatial frequency (according to HVS models). Compared to the traditional gamma curve, which represents the response curve of a physical cathode ray tube (CRT) device and coincidently may have a very rough similarity to the way the human visual system responds, a PQ curve, imitates the true visual response of the human visual system using a relatively simple functional model.

The IPT-PQ color space was first introduced in the '343 publication and combines a PQ mapping with the IPT color space as described in "*Development and testing of a color space* (*ipt*) *with improved hue uniformity*," Proc. $6^{th}$ Color Imaging Conference: Color Science, Systems, and Applications, IS&T, Scottsdale, Ariz., November 1998, pp. 8-13, by F. Ebner and M. D. Fairchild, which is incorporated herein by reference in its entirety. IPT is like the YCbCr or CIE-Lab color spaces; however, it has been shown in some scientific studies to better mimic human visual processing than these spaces.

The display management process (115), with a single 3D LUT (210), works well when both the color volume of the target display and color encoding are fixed; however, for some use cases both of these may change dynamically. For example, many devices, such as TVs or tablets, may support dynamic backlight technology, where the intensity of the backlight may change on a per frame or per scene basis. Changing the backlight affects both the available color volume as well as the color encoding, which in turn, requires the 3D LUT in CGM (210) to be updated. However, updating the 3D LUT is computationally intensive, which limits the number of updates that can be done in real-time, resulting in poor viewing experience. As appreciated by the inventors, it would be beneficial to allow for dynamic color-gamut mapping (or backlight control) without having to re-compute the 3D LUT.

3D LUT Interpolation

Without loss of generality, given an input in a first color representation (say, in the IPT color space using ST 2084, or IPT-PQ), a 3D LUT for CGM generates output values in a second color representation (say, in RGB-PQ) assuming a given set of color primaries (say, Rec. 709). In a preferred embodiment, without limitation, the output color space is in RGB instead of say, YCbCr, since in most applications the PQ encoding after display management may change to some other, more commonly used, encoding (say, gamma encoding as defined by BT 1886), which is only possible in the RGB domain.

Figure 3:
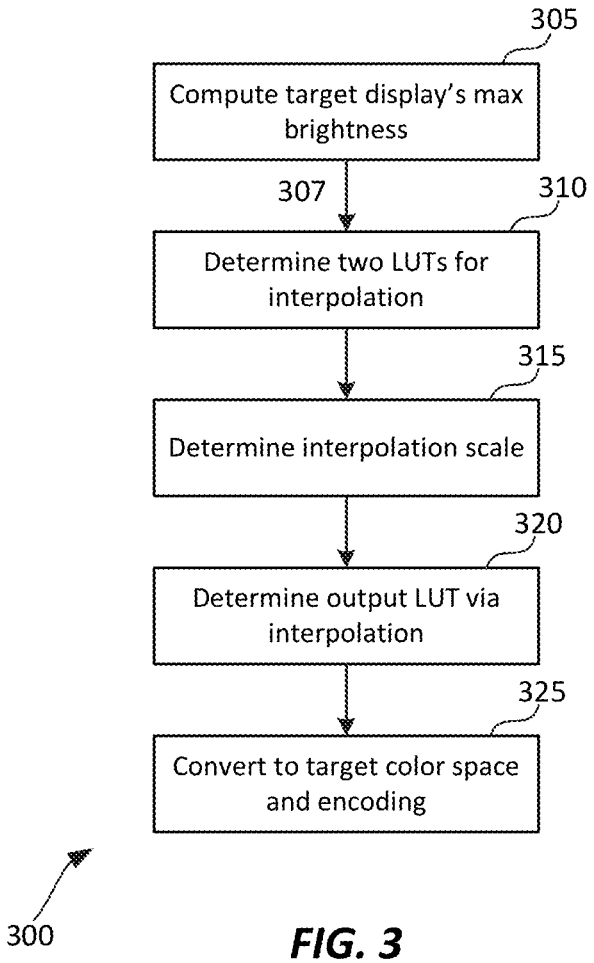
FIG. 3 depicts an example process for color gamut processing using 3D LUT interpolation according to an embodiment of this invention.

FIG. 3 depicts an example process for color gamut processing using 3D LUT interpolation according to an embodiment. Given a display that can be adjusted to display at a variety of possible maximum brightness values (e.g., by adjusting the backlight), given a video input (e.g., 102), a display management process (e.g., 100) computes first the desired maximum brightness of the target display, to be denoted as TMax or TMaxPQ. As used herein, the term "PQ" at the end of variable name, say TMaxPQ, denotes that the variable's original value (say TMax=400 nits) is mapped to a value in the (0,1) range according to the ST 2084 EOTF. Examples of optimum adjustment of the target display brightness are described in U.S. Provisional application Ser. No. 62/193,678, "Backlight control and display mapping for high dynamic range images," filed on Jul. 17, 2015, (also filed, on May 11, 2016, as PCT/US2016/031920) which is incorporated herein by reference in its entirety.

In an embodiment, let LUT(i), i=1, 2, . . . , N, (N≥2), denote a set of pre-computed 3D CGM LUTs, each one targeting a specific color volume for a maximum target display luminance level, to be denoted as LUTMax(i) (e.g., for N=4, LUTMax(i)={100, 200, 300, and 400} nits). Let LUTMaxPQ(i), denote the maximum target brightness for LUT(i) in the PQ domain. In step (310), given TMaxPQ, two LUTs (say LUT(A) and LUT(B) are determined to generate the output LUT (LUTOut). For example, in an embodiment, the two LUTs may be selected so that $$\mathrm{LUTMaxPQ}(A)>\mathrm{TMaxPQ}>\mathrm{LUTMaxPQ}(B). \tag{1}$$

Let alpha denote an interpolation scale to be used to interpolate LUTOut based on LUT(A) and LUT(B), then, in an embodiment, in step (315), a linear interpolation scale may be generated as:

$$\mathrm{alpha} = (\mathrm{LUTMaxPQ}(A)-\mathrm{TMaxPQ})/(\mathrm{LUTMaxPQ}(A)-\mathrm{LUTMaxPQ}(B)). \tag{2}$$

Given alpha, in step (320), values v of the output LUT may be computed as $$\mathrm{LUTOut}(v)=\mathrm{alpha}*\mathrm{LUT}(B)(v)+(1-\mathrm{alpha})*\mathrm{LUT}(A)(v), \tag{3}$$

where v denotes an input vector (say, IPT values). In a preferred embodiment, the interpolation points for all LUT (i)s may be identical to simplify computations.

Figure 4:
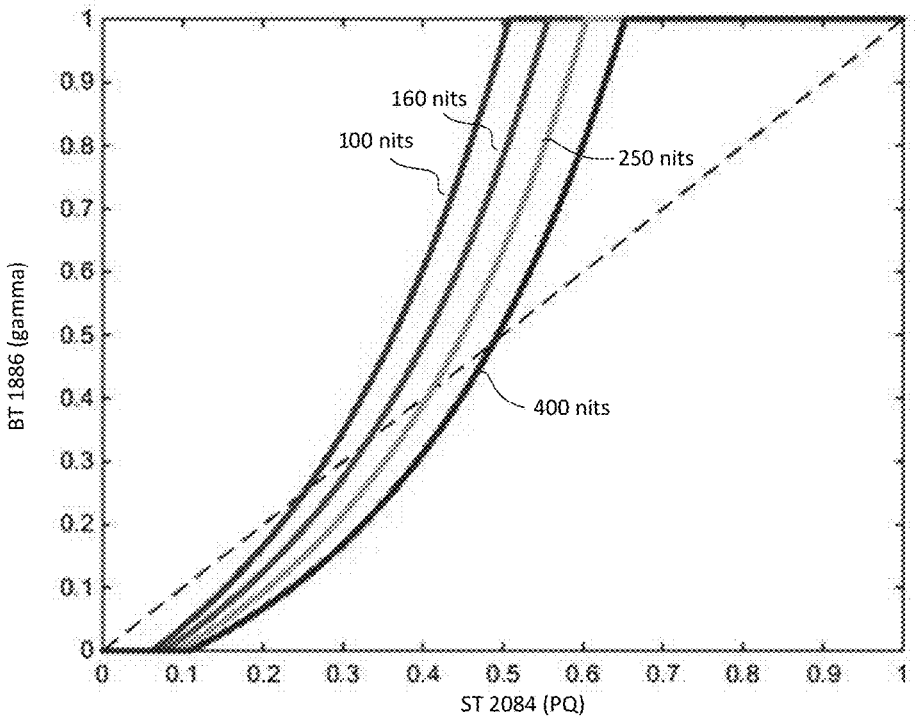
FIG. 4 depicts examples of ST 2084 (PQ) to BT 1886 (gamma) mappings according to an embodiment of this invention.

Since, as discussed earlier, in a preferred embodiment, the output of LUTOut is in RGB-PQ, its output may need to be adapted according to the expected input for the target display. For example, if the target display expects YCbCr in BT 1886, then step (325) may include the following steps:

- Convert RGB-PQ to linear RGB, using an inverse transformation defined by ST 2084
- Convert linear RGB to RGB-BT1886 using the BT1866 specification
- Convert RGB-BT1886 to YCbCr-BT1886 using an RGB to YCbCr transformation These steps can be applied directly to the output of the interpolated LUTOut table; however, they may require too many computations to be effectively supported by the target device. A more computationally-efficient approach may include the following steps:

Offline (Pre-computed)

a) Select K, (K≥2), possible maximum luminance levels for the target display. In an embodiment, it is preferred for these values to be evenly spaced in the PQ domain (say, 100, 160, 250, and 400 nits)

b) For each of these luminance levels (say, LPQ(i), i=1 to K), compute PQ to linear and linear to BT 1866 values, to generate a PQ to BT 1886 mapping (e.g., PQtoBT1886L(i)). An example of such mapping for four maximum brightness values (e.g., K=4, L(i)={100, 160, 250, and 400} nits) is depicted in FIG. 4.

In Real-time (On a Per-frame or a Per-scene Basis)

Using TMaxPQ (the maximum brightness level of the target display), compute the target RGB-BT1886 values by interpolation:

$$\mathrm{PQtoBT1886Out}(v)=\mathrm{beta}*\mathrm{PQtoBT1886}L(B)(v)+(1-\mathrm{beta})*\mathrm{PQtoBT1886}L(A)(v), \tag{4}$$

where v denotes the R, G, or B pixel value at the output of equation (3) in RGB-PQ domain, and as before, the PQtoBT1886(A) and PQtoBT1886(B) LUTs may be selected so that in nits $$L(A)>\text{TMax}>L(B), \tag{5a}$$

or in the PQ domain $$\text{LPQ}(A)>\text{TMaxPQ}>\text{LPQ}(B). \tag{5b}$$

Using linear interpolation, as before, the interpolation scale beta in equation (4) may be expressed as:

$$\text{beta} = \frac{LPQ(A) - TMaxPQ}{LPQ(A) - LPQ(B)}.$$

Note that in some embodiments, the number of 3D LUTs (e.g., N) used to determine the interpolated CGM LUTOut in step (310) may be different than the number of LUTs (e.g., K) used to do the color conversion in step (325).

In some embodiments, due to the non-linear relationship between the target device maximum brightness levels, the performance of the interpolation method may be improved significantly by precomputing additional tables of interpolation parameters (alpha). In an embodiment, such tables may be computed as follows:

Offline a) Generate a list of M, M≥2, maximum target display luminance levels denoted as LalphaPQ(i). For example, for M=16, let Lalpha(i)={100, 110, 121, 133, 146, 160, 176, 193, 212, 232, 254, 279, 305, 334, 366, 400} in nits.

b) Translate these luminance values from PQ to linear and from linear to BT 1886 to generate $\text{LalphaBT}_{L)j)}$)(i) values. Note that, as depicted in FIG. 4, the PQ to BT mapping depends on the maximum luminance of the target display (L(j), j=1 to K), hence a separate table needs to be generated for each potential maximum brightness display value (e,g., for K=4, L(j)={100, 160, 250, and 400} nits).

c) Compute the interpolation values for each of these M and K values: $\text{alpha}_{L(j)}(i)=(1-\text{LalphaBT}_{L(j)}(i))/(\text{LalphaBT}_{L(j)})(i+1)-\text{LalphaBT}_{L(j)}(i))$, for i=1 to M, and j=1 to K.

Given these $\text{alpha}_{L(j)}(i)$ values, additional alpha values for LalphaPQ values not in the input set (LalphaPQ(i)), can be computed by simple linear interpolation.

Figure 5:
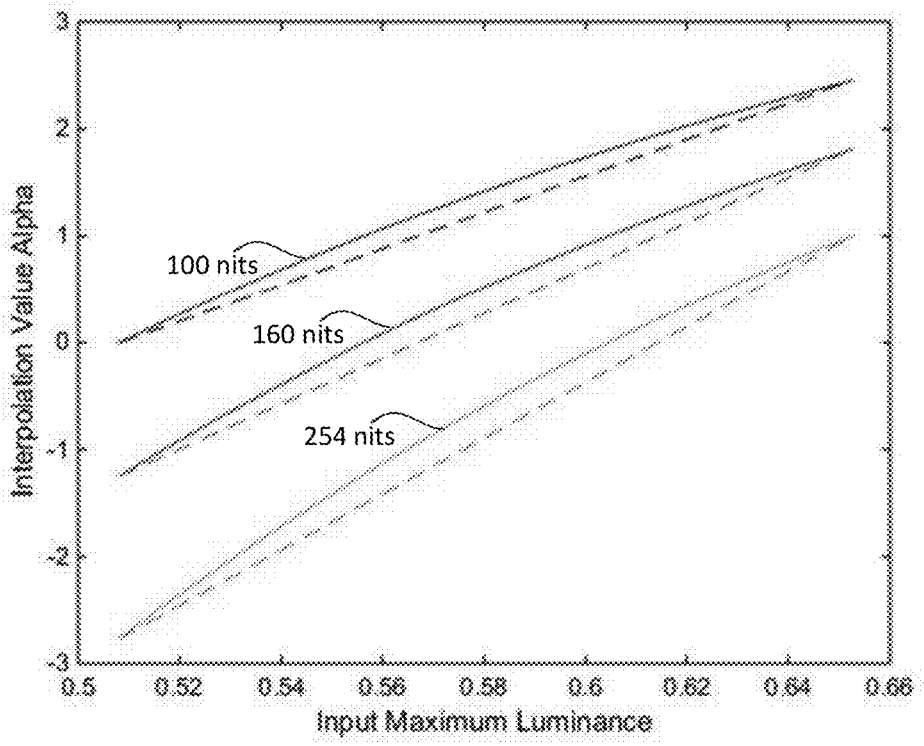
FIG. 5 depicts examples of 3D LUT interpolation scalers computed according to embodiments of this invention.

FIG. 5 shows example alpha values computed by both the default method of equation (2) (straight dotted lines) and the new method that relies on a PQ to BT 1866 mapping (curved solid lines), for maximum luminance values (L(j)) at 100, 160, and 254 nits. Hence, given an input TMaxPQ value, an upper boundary brightness value (L1) and a lower boundary brightness value (L2), in an embodiment, one can compute the preferred interpolation scale as follows:

In Real-time a) As in step (310), determine the two CGM 3D LUTs to be used for interpolation; say, LUT(A) and LUT(B), where L1=LUTMaxPQ(A)>TMaxPQ>LUTMaxPQ(B)=L2 b) Compute alpha based on the pre-computed $\text{alpha}_{L(j)}(i)$ values; for example, for $$s = \frac{LUTMaxPQ(A) - TMax}{LUTMaxPQ(A) - LUTMaxPQ(B)},$$

$\text{alpha}=s*\text{alpha}_{L2}(\text{TMaxPQ})+(1-s)*\text{alpha}_{L1}(\text{TMaxPQ})$ c) Using the computed alpha, use equation (3) to generate LUTOut d) Use the PQtoBT1886 LUTs to convert the output of LUTOut to RGB-BT1866 values e) Optionally, convert the RGB-BT1866 values to YCbCr or any other desired color format Example Computer System Implementation Embodiments of the present invention may be implemented with a computer system, systems configured in electronic circuitry and components, an integrated circuit (IC) device such as a microcontroller, a field programmable gate array (FPGA), or another configurable or programmable logic device (PLD), a discrete time or digital signal processor (DSP), an application specific IC (ASIC), and/or apparatus that includes one or more of such systems, devices or components. The computer and/or IC may perform, control, or execute instructions relating to backlight control and display mapping processes, such as those described herein. The computer and/or IC may compute any of a variety of parameters or values that relate to backlight control and display mapping processes described herein. The image and video embodiments may be implemented in hardware, software, firmware and various combinations thereof.

Certain implementations of the invention comprise computer processors which execute software instructions which cause the processors to perform a method of the invention. For example, one or more processors in a display, an encoder, a set top box, a transcoder or the like may implement methods related to backlight control and display mapping processes as described above by executing software instructions in a program memory accessible to the processors. The invention may also be provided in the form of a program product. The program product may comprise any non-transitory medium which carries a set of computer-readable signals comprising instructions which, when executed by a data processor, cause the data processor to execute a method of the invention. Program products according to the invention may be in any of a wide variety of forms. The program product may comprise, for example, physical media such as magnetic data storage media including floppy diskettes, hard disk drives, optical data storage media including CD ROMs, DVDs, electronic data storage media including ROMs, flash RAM, or the like. The computer-readable signals on the program product may optionally be compressed or encrypted.

Where a component (e.g. a software module, processor, assembly, device, circuit, etc.) is referred to above, unless otherwise indicated, reference to that component (including a reference to a "means") should be interpreted as including as equivalents of that component any component which performs the function of the described component (e.g., that is functionally equivalent), including components which are not structurally equivalent to the disclosed structure which performs the function in the illustrated example embodiments of the invention.

Equivalents, Extensions, Alternatives and Miscellaneous

Example embodiments that relate to efficient backlight control and display mapping processes are thus described. In the foregoing specification, embodiments of the present invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method for adaptive display management with a computer, the method comprising:

receiving a target maximum brightness value for a display;

selecting, based on the target maximum brightness value for the display from more than two maximum brightness values each of which a look-up table is pre-computed, a first maximum brightness and a second maximum brightness value;

determining a first look-up table pre-computed for the first maximum brightness value which is higher than the target maximum brightness value;

determining a second look-up table pre-computed for the second maximum brightness value which is lower than the target maximum brightness value;

computing a first interpolation scale based on the target maximum brightness value and at least the first maximum brightness value; and determining an output look-up table, wherein a value of the output look-up table is computed using the first interpolation scale by interpolating corresponding values between the first look-up table and the second look-up table, wherein computing the first interpolation scale comprises:

for each (j) first brightness value L(j):

for each (i) second brightness value LalphaPQ(i):

generating a third brightness value $LalphaBT_{L(j)}(i)$ by converting the second brightness value from a first color representation to a second color representation based on the first brightness value; and computing an $alpha_{L(j)}(i)$ value based on the third brightness value, wherein $$alpha_{L(j)}(i)=(1-LalphaBT_{L(j)}(i))/(LalphaBT_{L(j)}(i+1)-LalphaBT_{L(j)}(i)).$$

2. The method of claim 1, wherein each of the first look-up table, the second look-up table, and the output look-up table characterizes an input output relationship between input IPT values encoded according to the SMPTE ST 2084 specification and output RGB values encoded according to the SMPTE ST 2084 specification.

3. The method of claim 2, wherein each of the first look-up table, the second look-up table, and the output look-up table comprise 3D look-up tables for color gamut mapping.

4. The method of claim 1, wherein computing the first interpolation scale (alpha) comprises computing with the computer:

$$alpha=(LUTMaxPQ(A)-TMaxPQ)/(LUTMaxPQ(A)-LUTMaxPQ(B)),$$

where TMaxPQ denotes the target maximum brightness value for the display, LUTMaxPQ(A) denotes the first maximum brightness value for the first look-up table, and LUTMaxPQ(B) denotes the second maximum brightness value for the second look-up table.

5. The method of claim 1, wherein determining the output look-up table comprises computing with the computer:

$$LUTOut(v)=alpha*LUT(B)(v)+(1-alpha)*LUT(A)(v),$$

wherein alpha denotes the first interpolation scale, LUT(A)(v) denotes an output of the first look-up table for an input v, LUT(B)(v) denotes an output of the second look-up table for the input v, and LUTOut(v) denotes an output of the output look-up table for the input v.

6. The method of claim 1, further comprising converting a first output value of the output LUT which is encoded according to a first color representation to a second output value which is encoded in a second color representation.

7. The method of claim 6, wherein the first color representation is RGB in SMPTE ST 2084 and the second color representation is RGB in BT1866.

8. The method of claim 7, wherein converting from the first color representation to the second color representation comprises:

converting the first output value to a linear RGB value; and converting the linear RGB value to an RGB BT1866 second output value.

9. The method of claim 8, further comprising:

converting the RGB BT1866 value to a YCbCr BT1866 value using an RGB to YCbCr color transformation.

10. The method of claim 7, wherein converting from the first color representation to the second color representation comprises:

for each of two or more luminance values:

pre-computing an ST 2084 (PQ) to BT 1866 (gamma) look-up table mapping input pixel values encoded in SMPTE ST 2084 to output pixel values encoded in BT 1866;

determining an output PQ to gamma look-up table based on the target maximum brightness value for the display, a second interpolation scale, and the two or more pre-computed PQ to gamma look-up tables; and converting an output value of the output lookup table from an RGB ST 2084 value to an RGB BT1866 value using the output PQ to gamma look-up table.

11. The method of claim 10, wherein determining the output PQ to gamma table comprises computing with the computer:

$$PQtoBT1886Out(v)=beta*PQtoBT1886(B)(v)+(1-beta)*PQtoBT1886(A)(v),$$

where for a value v, PQtoBT1886(A)(v) denotes an output from a first precomputed PQ to gamma LUT computed for a first brightness value higher than the target maximum brightness value, PQtoBT1886(B)(v) denotes an output from a second precomputed PQ to gamma LUT computed for a second brightness value lower than the target maximum brightness value, beta denotes the second interpolation scale, and PQtoBT1886Out(v) denotes the corresponding output PQ to gamma value.

12. The method of claim 1, further comprising:

computing the first interpolation scale based on the target maximum brightness value for the display, the first maximum brightness value, the second maximum brightness value, and the $alpha_{L(j)}(i)$ values.

13. The method of claim 12, wherein computing the first interpolation scale comprises interpolating between a first $alpha_{L1}(TMaxPQ)$ and a second $alpha_{L2}(TMaxPQ)$ value, wherein L1 denotes the first maximum brightness value, L2 denotes the second maximum brightness value, and TMaxPQ denotes the target maximum brightness value for the display.

14. An apparatus comprising a processor and configured to perform the method recited in claim 1.

15. A non-transitory computer-readable storage medium having stored thereon computer-executable instruction for executing a method with one or more processors in accordance with claim 1.

* * * * *